US010921082B2

(12) United States Patent
Todd

(10) Patent No.: US 10,921,082 B2
(45) Date of Patent: Feb. 16, 2021

(54) SPRING LOADED QUICK RELEASE SYSTEM

(71) Applicant: Backlanz Limited, Invercargill (NZ)

(72) Inventor: Ethan Todd, Invercargill (NZ)

(73) Assignee: BACKLANZ LIMITED, Invercargill (NZ)

( * ) Notice: Subject to any disclaimer, the term of this patent is extended or adjusted under 35 U.S.C. 154(b) by 0 days.

(21) Appl. No.: 16/569,822

(22) Filed: Sep. 13, 2019

(65) Prior Publication Data

US 2020/0088488 A1 Mar. 19, 2020

(30) Foreign Application Priority Data

Mar. 6, 2019 (NZ) ..... 751388

(51) Int. Cl.
*F41A 23/10* (2006.01)
*F41A 23/52* (2006.01)

(52) U.S. Cl.
CPC ..... *F41A 23/10* (2013.01); *F41A 23/52* (2013.01)

(58) Field of Classification Search
CPC ..... F41A 23/08; F41A 23/10; F41A 23/12; F41A 23/14; F41A 23/52; F16M 2200/024
See application file for complete search history.

(56) References Cited

U.S. PATENT DOCUMENTS 3,523,670 A * 8/1970 Pfister et al. ..... F41A 23/12 248/168
4,699,347 A * 10/1987 Kuhnley ..... A47G 33/1213 248/230.8
8,651,507 B2 * 2/2014 Kylstra ..... A61G 5/10 280/250.1
2015/0045924 A1 * 2/2015 Cluckers ..... B29C 64/386 700/98
2017/0167817 A1 * 6/2017 Hayes ..... F41A 23/10
2019/0154190 A1 * 5/2019 Yun ..... F16M 11/105

FOREIGN PATENT DOCUMENTS

DE 2348539 A1 * 4/1975 ..... F41A 23/12

* cited by examiner

*Primary Examiner* — Stephen Johnson
(74) *Attorney, Agent, or Firm* — Jacobson Holman PLLC

(57) ABSTRACT

The invention provides a quick release mechanism that allows two component parts to be connected to and disconnected from each other easily. In particular the invention provides a clip on and off system that allows two components to be connected together at the push of a button. The invention is particularly intended as a quick release system for the attachment of a firearm to a bipod.

7 Claims, 11 Drawing Sheets

SPRING LOADED QUICK RELEASE SYSTEM

FIELD OF THE INVENTION

The invention provides a quick release mechanism that allows two component parts to be connected to and disconnected from each other easily. In particular the invention provides a clip on and off system that allows two components to be connected together at the push of a button. The invention is particularly intended as a quick release system for the attachment of a firearm to a bipod.

BACKGROUND TO THE INVENTION

When using a firearm in conjunction with a bipod, it is much easier to keep the bipod detached from the firearm when not in use. It is a lot easier to carry as it does not dig into a wearer's back when slung over their shoulder whilst being carried or and it does not get stuck on a backpack or caught on any bush the shooter maybe traveling through. Having the bipod disconnected also makes the firearm a lot lighter when the shooter wants to perform a shot from a standing position.

The problem for the firearm user is that once he or she wants to use the firearm with the bipod attached, they must secure the two together which often takes time and is cumbersome. The present invention was created to make a bipod more easily connected to a firearm and to give the shooter the option of keeping the bipod detached.

OBJECT OF THE INVENTION

It is therefore an object of this invention to provide a simple system where a firearm can be attached and detached from a bipod, or to at least provide the user with a choice.

SUMMARY OF THE INVENTION

The invention provides a spring-loaded quick release mechanism which allows two components to be connected and disconnected quickly at the push of a button. A first component is preferably a firearm, and a second component is preferably a bipod.

Alternatively, one component may be a tripod and another component may be a camera or other piece of equipment.

When connected, the components are held firmly together by forces generated by the spring of the quick-release system but whilst being held firmly together, rotation and pivoting are still possible.

The invention provides a spring-loaded quick release mechanism comprising:

a ball pin attached to a first component;

a quick-release mechanism attached to a second component; and whereby upon engagement between the ball pin and the quick-release mechanism the first and second components are releasably attached.

Preferably the quick-release mechanism comprises a compression spring which spring loads the quick-release mechanism when a force is applied to the mechanism either by the ball pin or a latch on the quick-release mechanism being depressed. This quick-release mechanism, or spring-loaded latch is a key feature of the invention in firmly holding the first and second components together. This mechanism may be made from a variety of materials, although metal has advantages over plastics as the components then slide over each other more smoothly. The mechanism may be 3D printed.

The ball pin is preferably of a specific length to allow the quick-release mechanism, when depressed, to engage onto the ball pin to thus maintain the compression spring under compression. The ball pin may be adjustable in length which allows varying degrees of tension to be applied to the two components which are being held together.

The ball pin may be attached to a mounting bracket which is itself attached to the underside of a first component. The first component is preferably a firearm.

The mounting bracket may be 3D printed in metal, and preferably stainless steel. This makes it light in weight.

The quick-release mechanism may be housed in a latch housing which may be held onto the bipod by mounting screws. The latch housing may be 3D printed in metal and more preferably in stainless steel, but it could alternatively be printed, machined or injection moulded in a plastic.

The housing may include a centre locator.

The housing may include a lip mechanism to prevent the latch from overloading.

However, within the scope of the invention is included a housing manufactured in a single piece with a second component (such as the bipod). In this instance, the bipod and housing would not be screwed together.

The quick-release mechanism preferably includes a push button for release, which, when depressed, disengages the ball pin from the quick-release latch, detaching the bipod from the mounting bracket.

The invention proves a method of releasably attaching a bipod to a firearm comprising the use of a spring-loaded quick-release mechanism as described in this specification.

It is acknowledged that the terms "comprise", "comprises" and "comprising" may, under varying jurisdictions, be attributed with either an exclusive or an inclusive meaning. For the purpose of this specification, and unless otherwise noted, these terms are intended to have an inclusive meaning—i.e. they will be taken to mean an inclusion of not only the listed components which the use directly references, but also to other non-specified components or elements.

DESCRIPTION OF THE DRAWINGS

FIG. 1 is a view of the mounting bracket fitted to a firearm with a sling attached to the stop block.

FIG. 2 is a view of a bipod with latch engaged onto the mounting bracket—legs down.

FIG. 3 is a view of a bipod with latch fitted engaged onto the mounting bracket—legs up.

FIG. 10 consists of 10A-10M which show various components and views.

DETAILED DESCRIPTION OF THE INVENTION

Figure 1:
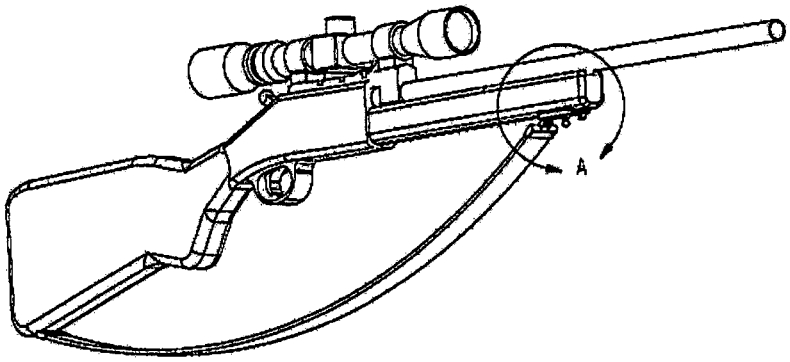
FIG. 1 consists of FIGS. 1 and 1A.
Figure 1A:
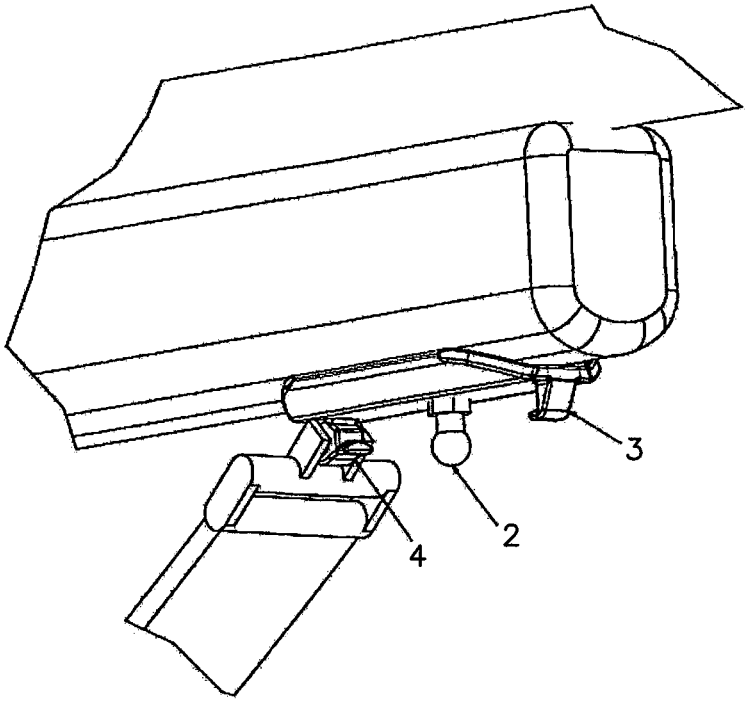
FIG. 1A is a close up view of the mounting bracket fitted to a firearm.
Figure 2:
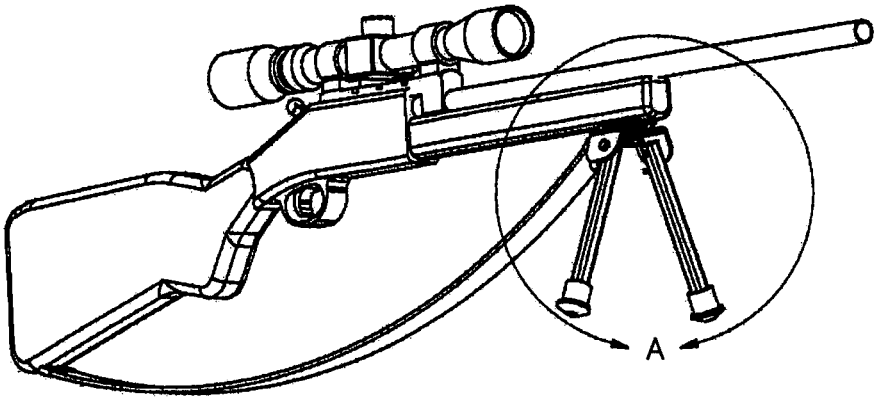
FIG. 2 consists of FIGS. 2 and 2A.
Figure 2A:
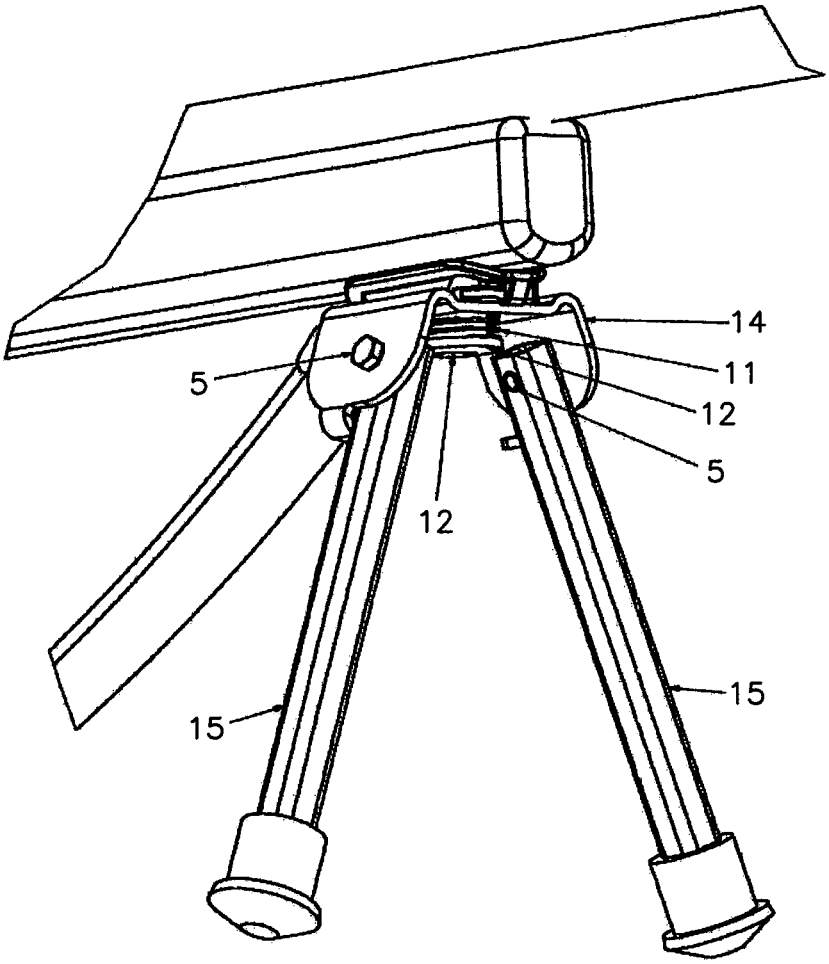
FIG. 2A is a close up view of a bipod with latch engaged onto the mounting bracket—legs down.
Figure 3:
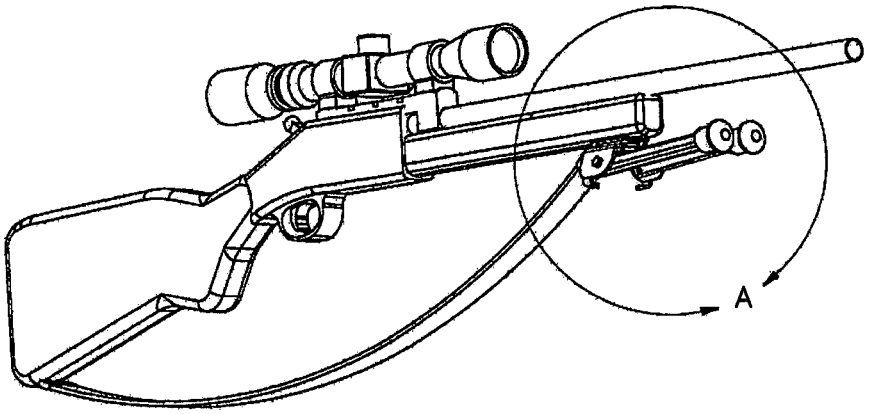
FIG. 3 consists of FIGS. 3 and 3A.
Figure 3A:
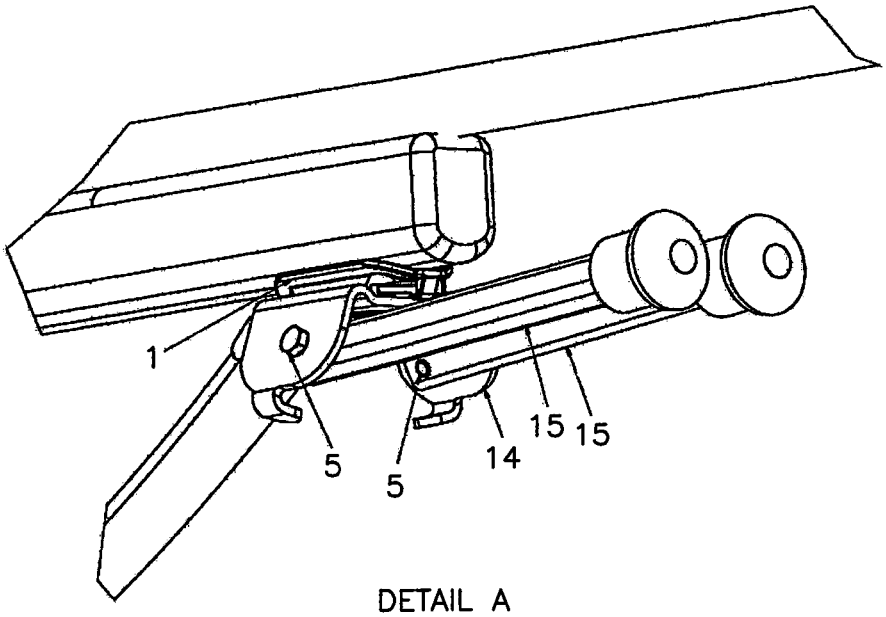
FIG. 3A is a close up view of a bipod with latch fitted engaged onto the mounting bracket—legs up.
Figure 4:
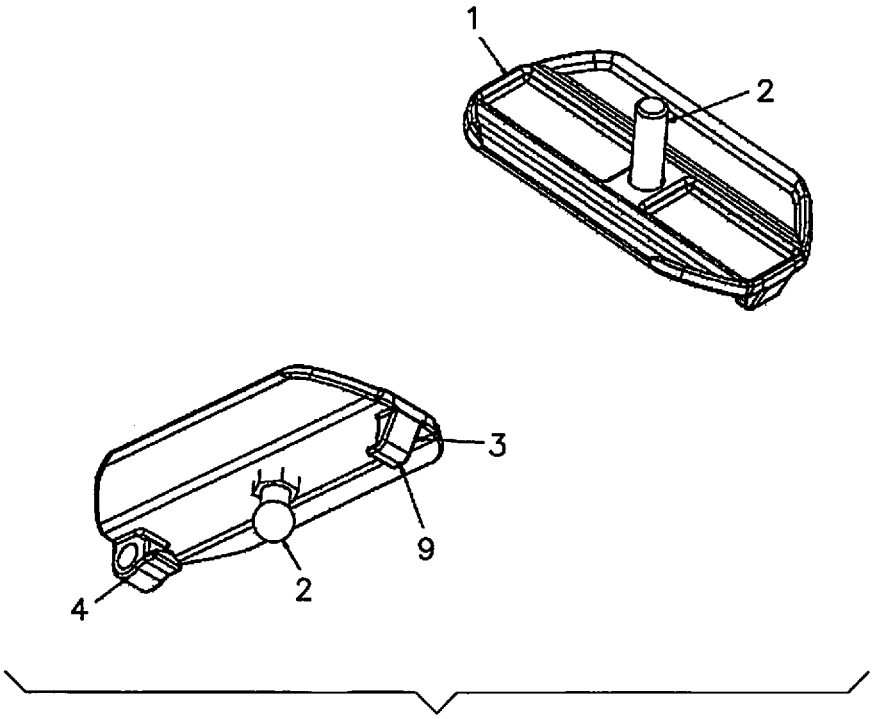
FIG. 4 shows a mounting bracket. Although this is shown with a curved surface, the surface could be flat right across without sloped edges. It is not essential that the housing comprises a centre locator or lips to prevent the latch from overloading.
Figure 5:
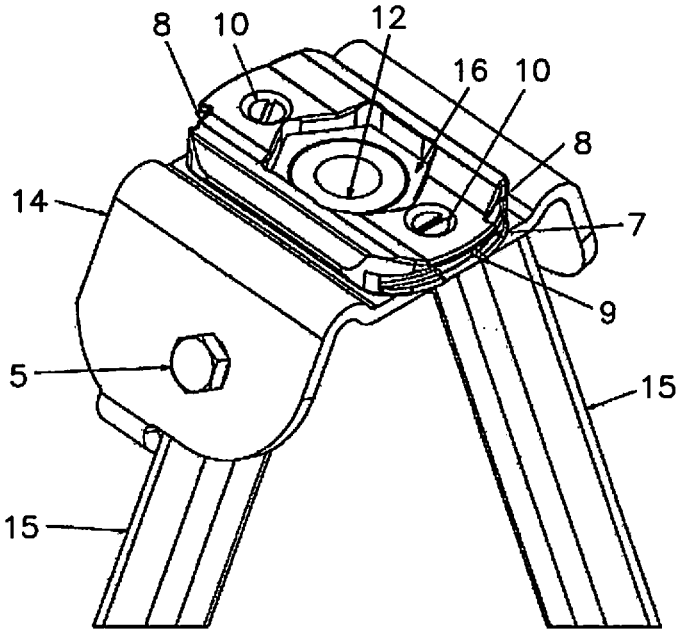
FIG. 5 is a view of the latch housing fitted to a bipod.
Figure 6:
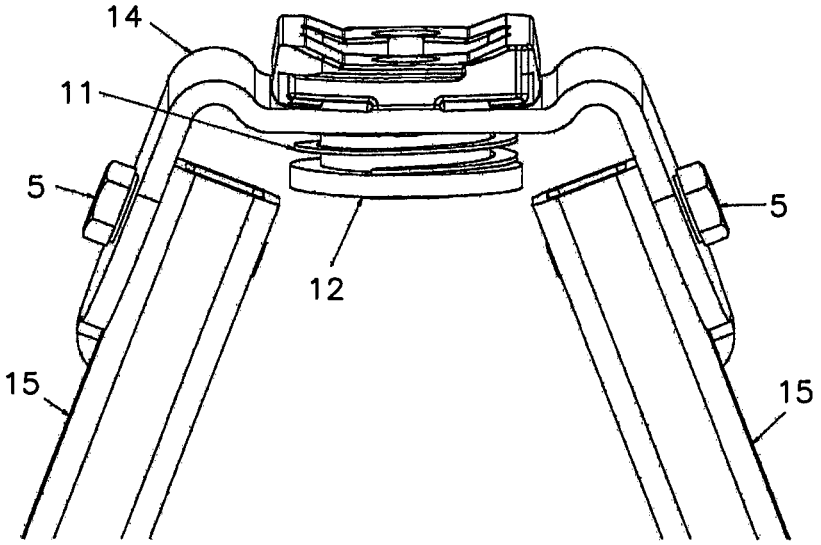
FIG. 6 is a front view of the latching mechanism and latch housing fitted to a bipod.
Figure 7:
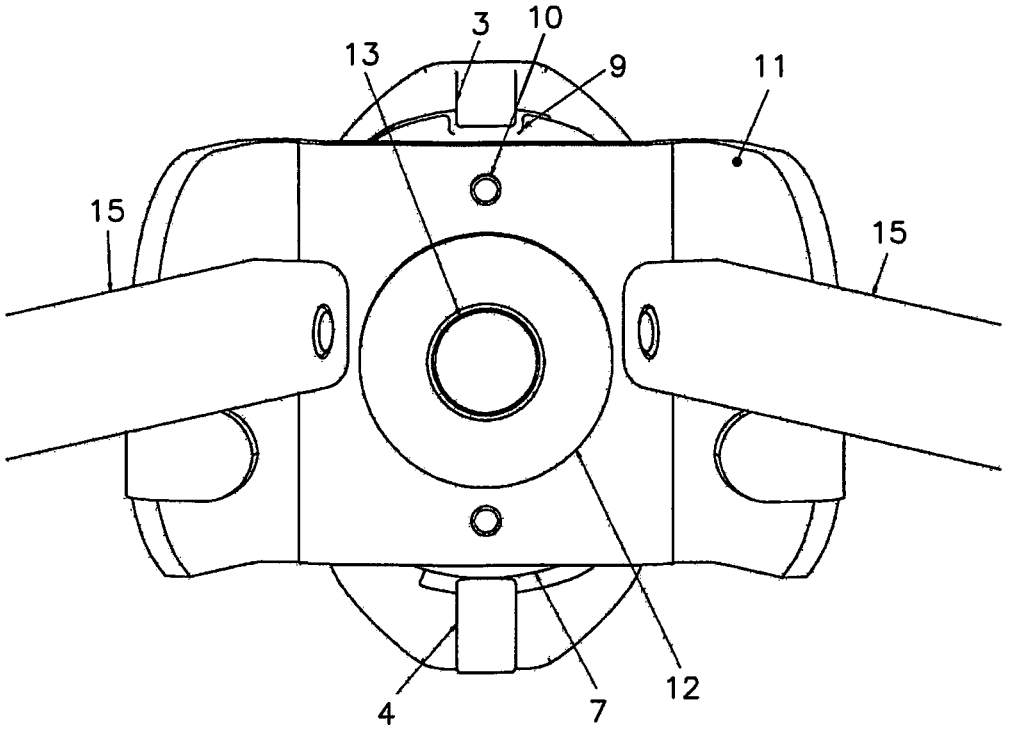
FIG. 7 is a view from underneath of the latching mechanism and latch housing fitted to a bipod with a mounting bracket attached.
Figure 8:
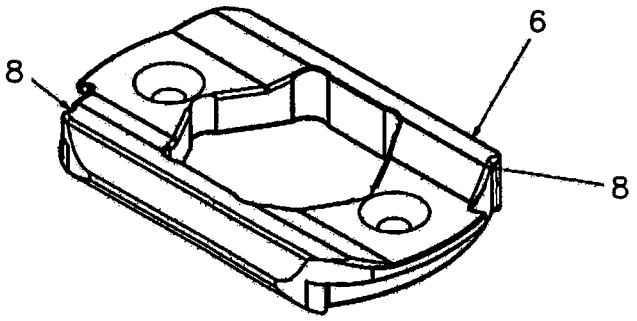
FIG. 8 is a view of the latching mechanism fitted to a bipod and the latch housing detached.
Figure 9:
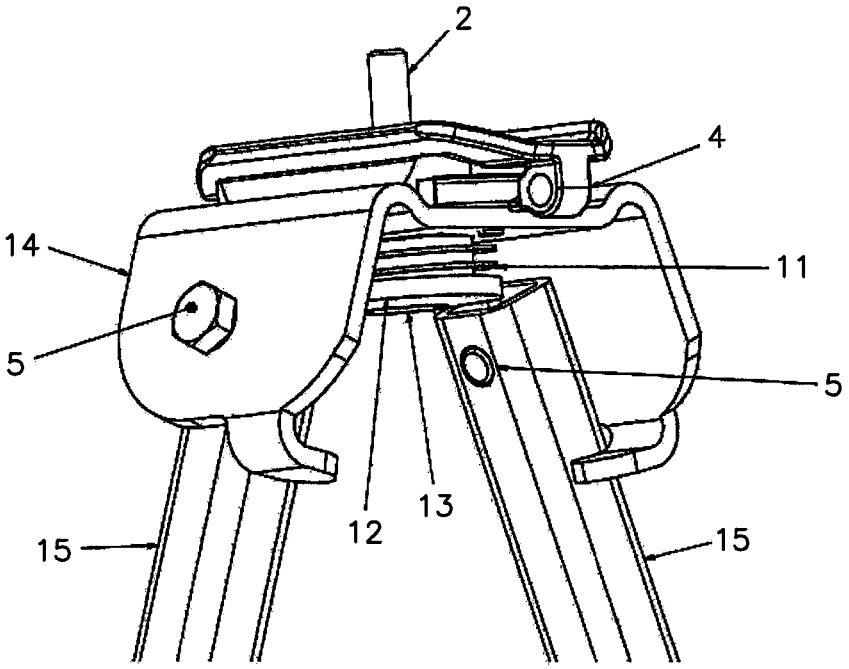
FIG. 9 is a view of the latching mechanism engaged onto the mounting bracket.

Description of Parts:

Mounting bracket 1. This is used to accommodate the ball pin 2. The bracket is mounted onto the stock of a firearm with the ball pin. This ensures a centralised mounting point and fewer components.

Ball pin 2. This connects the bracket 1 that is attached to the firearm to the quick release latch 12 that is fitted to the bipod. The ball pin is of a certain length to allow the quick release latch 12 when depressed, to engage onto the ball pin 2 and keep a spring 11 under compression when released. The ball pin 2 transfers force from the mounting bracket 1 into the quick release latch 12 allowing the firearm to pivot side to side with movement of the spring 11.

Stop block 3. The purpose of the stop block is to catch on the lip of the latch housing 6 to prevent the latch from being overloaded with leverage forces from the bipod legs. The stop block also locates the mounting bracket in slots on the latch housing. The forward stop block also holds the centre lock on the latch housing. This is an advantage because it allows the firearm to pan horizontally side to side.

There is provided a hole in the stop block to allow the attachment of a sling, strap or the like that is used to carry the firearm over a user's shoulder.

Attachment means for bipod legs, in this embodiment shown as bipod leg pivot bolts. These allow the legs to be folded up and down into position.

Latch Housing 6. This is used to hold the hexagonal nut 5 that holds the quick release latch 12. The quick release latch travel travels up and down in the hexagonal hole. When the mounting bracket 1 and the bipod 14 are connected the latch housing 6 acts as a spacer allowing the mounting bracket 1 to hold firmly against the latch housing with the pressure that is generated by the spring 11. Angled surfaces rest against the mounting bracket so the bipod naturally wants to point longitudinally on the rifle but will allow panning of the rifle if force is applied.

Lips 7 on latch housing 6. These are to stop any excessive forces being applied to quick release latch 12 preventing it from failing.

Mounting bracket guide slots 8 are used to help locate the stops on the mounting bracket 1 in the correct location to rotate under the lips 7 on the latch housing 6. This is an advantage as it helps locate the bipod in the correct position when mounting it to the rifle.

Centre lock 9. This locates the bipod 14 parallel with the rifle to prevent the bipod from spinning when the bipod is in the legs up position. The forces on the quick release latch 12 holds the stop block 3 in the centre lock. When the bipod is in use on the rifle and forward pressure is applied the movement from the spring-loaded latch allows the stop on the mounting bracket 1 to lift up out of the centre lock. This then allows the rifle to pan horizontally.

Latch housing mounting screws 10 hold the latch housing 6 and bipod 14 together.

Multi wave compression spring 11 is used to spring load the quick release latch 12 when a force is applied to the center lock 9 either through the ball pin or the latch being depressed by hand, the spring 11 compresses and depresses allowing the latch to slide up and down through clearance hole in the bipod and the latch housing 6 allowing a range of movement for the bipod. Having the latch spring 11 loaded holds the bipod firmly against the mounting plate eliminating any unnecessary movement unless a force is applied to compress the spring. For the latch to be engaged onto the ball pin 2 the latch is depressed by hand until it is engaged onto the ball pin, When the hand pressure is released the spring pulls the mounting bracket 1 and the bipod and latch housing 6 together.

Quick release latch 12 is used to engage onto the ball pin 2 and hold the bipod 14 attached to the latch housing 6 and mounting bracket 1 together. The multi wave compression spring 11 is fitted over the body of the quick release latch 12 and sits between the bottom side of the bipod 14 and the flanged end of the latch. During manufacturing assembly, the latch is fitted through the clearance hole in the bipod and screwed into a low-profile nut, on the top side of the bipod that is held in place on the inside of the latch housing 6. When the latch is fitted through the clearance hole in the bipod and screwed into the low profile nut, the spring 11 becomes under compression. The latch travels up and down inside the latch housing inside the hexagonal hole when load is applied through it being pushed and pulled by the ball pin 2 when it is engaged into the quick release latch 12. For example, the firearm is able to be canted side to side as this movement is transferred through the ball pin 2 and into the spring-loaded center lock 9. The latch also allows rotational movement.

Push button release 13 is located on the quick release latch 12 and when it is depressed it disengages the ball pin 2 from the quick release latch 12, detaching the bipod 14 from the mounting bracket 1 attached to the firearm stock.

Bipod 14 accommodates the quick release latch 12, the latch housing 6 and the bipod legs 15.

Bipod legs 15 provide the stable platform for shooting, shown in perspective.

Figure 10A:
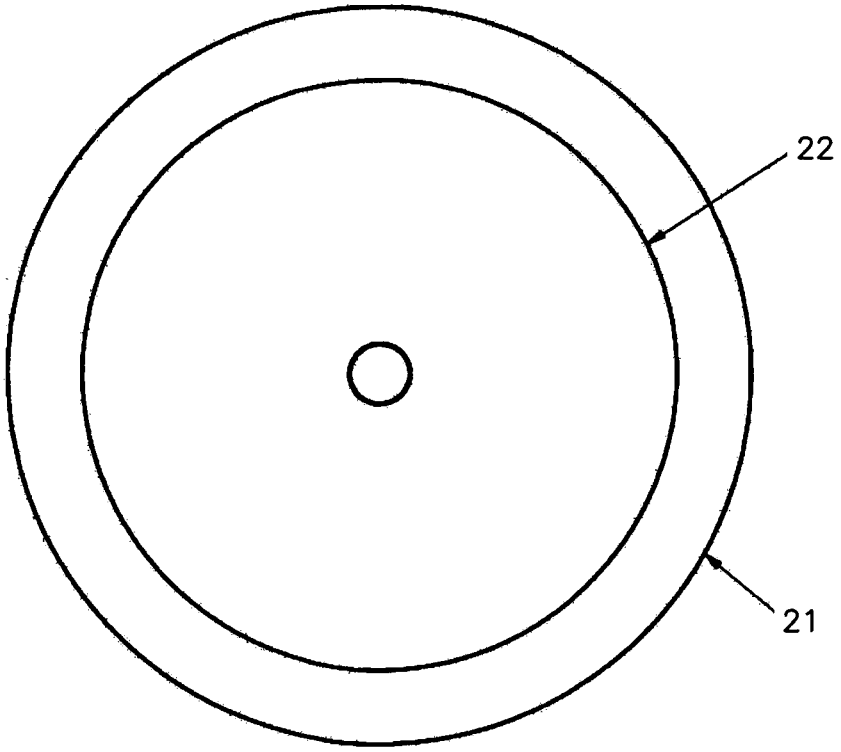
FIG. 10A shows components 21 and 22.
Figure 10B:
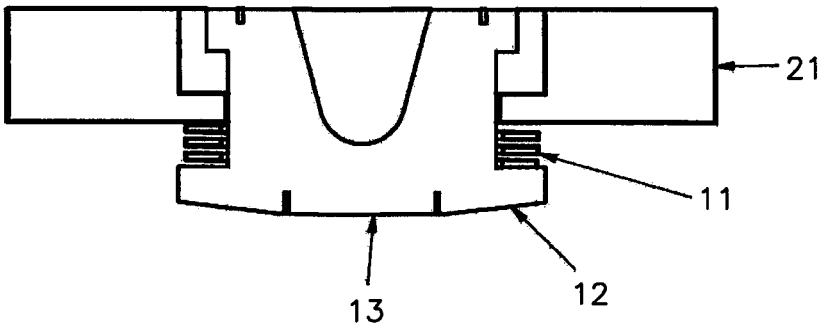
FIG. 10B shows component 21 with the latch depressed.
Figure 10C:
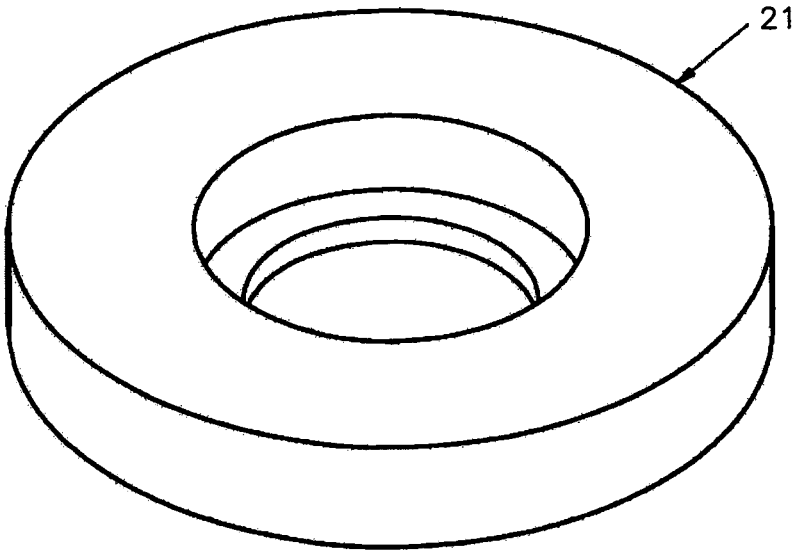
FIG. 10C shows component 21 without a latch.
Figure 10D:
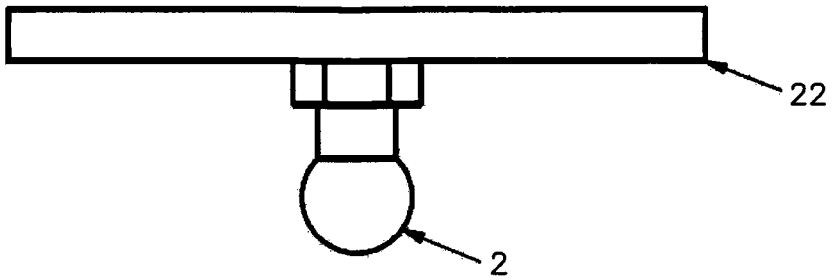
FIG. 10D shows component 22.
Figure 10E:
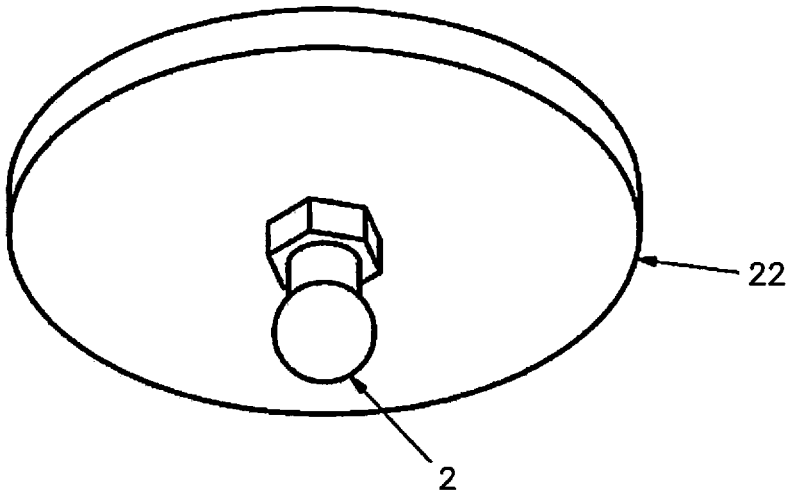
FIG. 10E shows component 22.
Figure 10F:
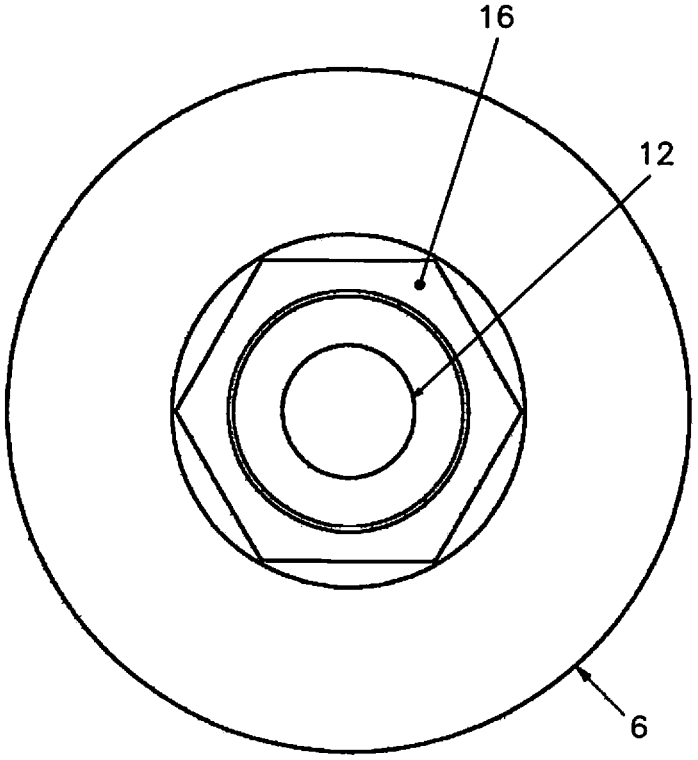
FIG. 10F shows component 21 with latch.
Figure 10G:
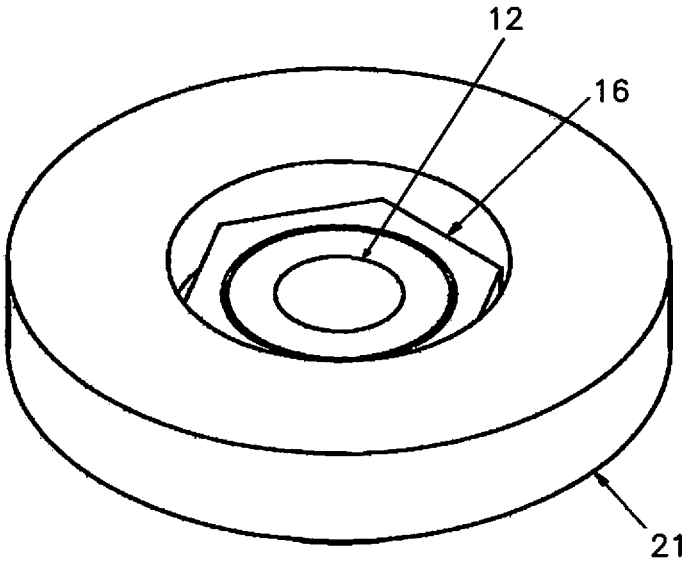
FIG. 10G shows component 21 with latch.
Figure 10H:
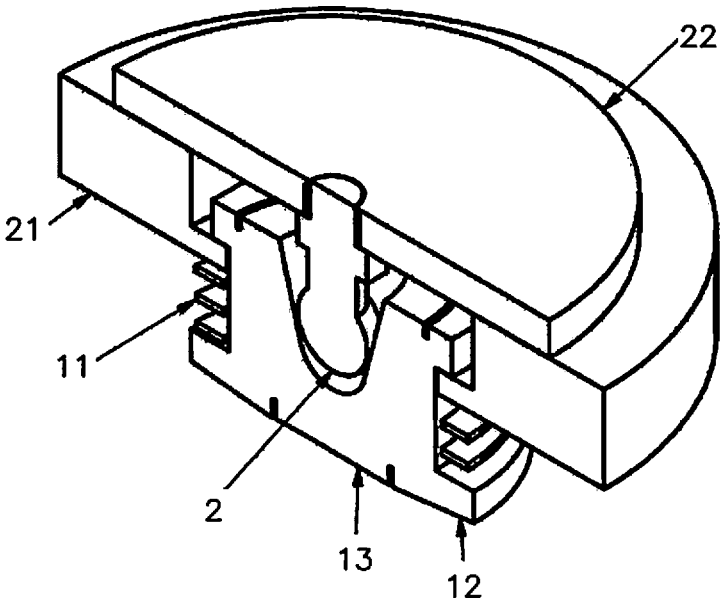
FIG. 10H shows a sectional view.
Figure 10K:
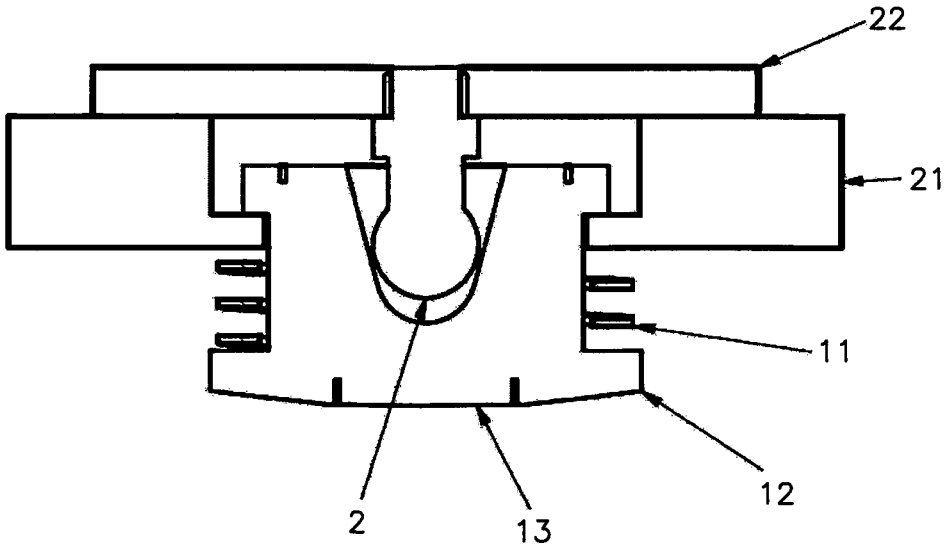
FIG. 10K shows a side sectional view.
Figure 10M:
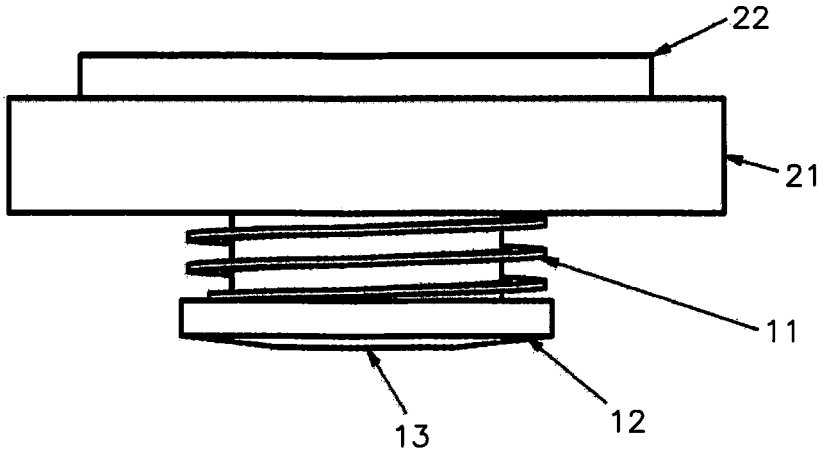
FIG. 10M shows a side view.

Referring now to FIGS. 10 A-M, there is shown:

First component 22 is attached to second component 21. The ball pin 2 is apart or attached to first component 22 that is used to connect first component 21 and second component 22 together.

Ball pin 2 holds the first and second components 21 and 22 together when the ball pin is engaged into the quick release latch 12. The ball pin is of a certain length to allow the quick release latch 12 when depressed, to engage onto the ball pin 2 and keep the spring 11 under compression when released. The ball pin 2 transfers force from the first component 22 into the quick release latch 12 allowing rotational movement. The Ball pin 2 can be fastened to first component 22 or even manufactured as one whole piece so the ball pin and first component 22 are one component.

First component 21 accommodates the quick release latch 12. Second component 21 has a hole the quick release latch 12 can slide through. First component 21 has a clearance hole that allows the low-profile nut 16 on the quick release latch 12 to slide up and down in it. The low-profile nut 16 sits at the bottom of the clearance hole and holds the latch in place. This stops the latch from falling through the first component 21.

The multi wave compression spring 11 is used to spring load the quick release latch 12. When a force is applied to the quick release latch either through the ball pin 2 or the latch being depressed by hand, the spring 11 compresses and depresses allowing the latch to slide up and down through clearance hole in second component 21 allowing a range for first component 22. Having the spring 11 loaded holds first component 21 firmly against the second component 22 eliminating any unnecessary movement unless a force is applied to compress the spring 11. For the quick release latch 12 to be engaged onto the ball pin the quick release latch 12 is depressed by hand until it is engaged onto the ball pin 2. When the hand pressure is released the spring 11 pulls the second 21 and the first component 22 together Quick release latch 12 is used to engage onto the ball pin 2 and hold the second component 21 and first component 22 together. The multi wave compression spring 11 is fitted over the body of the quick release latch 12 and sits between the bottom side of the second component 21 and the flanged end of the quick release latch 12. During manufacturing assembly, the quick release latch 12 is fitted through the clearance hole in second component 21 and screwed into a low-profile nut 16 on the top side of second component 21. When the quick release latch 12 is fitted through the clearance hole in the bipod 14 and screwed into the low profile nut 16 the spring 11 comes under compression. The quick release latch 12 travels up and down inside the clearance hole in second component 21 when load is applied through it being pushed and pulled by the ball pin 2 attached to first component 22 when it is engaged into the quick release latch 12. Second component 21 and first component 22 can also rotate whilst being held firmly together.

Push button release 13 is located on the quick release latch 12 and when it is depressed it disengages the ball pin from the quick release latch 12, detaching second component 21 from first component 22.

How to operate latching mechanism:

1. Rotate the mounting bracket stop blocks 3&4 into the guide slots 8 in the latch housing 6. The ball pin 2 that is attached to the mounting bracket 1 will now sit in the hole of the quick release latch 12.
2. From underneath apply force to the outside edges of the quick release latch 12 so the latch travels up through the latch housing 6 and engages onto the ball pin 2. When it engages a click will be heard.
3. Operate the bipod 14 as desired.
4. To horizontally pan, apply forward pressure to the firearm until the stop block 3 comes out of the centre lock 9.
5. To disconnect, depress the push button release 13 on the quick release latch 12 and the bipod 14 will detach.

It will be appreciated that whilst the invention has been described with reference to a specific embodiment and a specific use of the spring-loaded quick release mechanism, it may be used in other situations. When the latching mechanism was created it was realised this system could also be used on the likes of cameras/spotting scope and tripod by means of fixing a mounting bracket into the bottom of the camera/spotting scope and the latching system into the tripod. Having a mounting bracket for multiple items will also make the bipod or tripod universal as you could interchange the items. It is possible that this latching mechanism could be used on backpacks to allow the firearm or any other item to connect and disconnect from the backpack. Designs of other products such as tripod do not have the pivot block that slots into the latch housing allowing 360-degree rotation.

The invention claimed is:

1. A spring-loaded quick release mechanism which allows a first component and a second component to be connected and disconnected quickly with a push button release; the first component is a mounting bracket comprising a ball pin of specific length and an attachment; the second component is a quick release latch consisting of a spring, and a push button release; wherein the first and second components are connected and firmly held together by the force of the spring on the ball pin allowing rotation between the components, the push button release permits quick disconnection of the first and second components; the first component is attached to a fire arm and the second component is attached to bipod or a tripod.

2. The spring-loaded quick release mechanism according to claim 1, wherein the ball pin is of a specific length to allow the quick-release latch, when depressed, to engage onto the ball pin to thus maintain the spring under compression.

3. The spring-loaded quick release mechanism according to claim 1, wherein the ball pin is adjustable, allowing tension to be varied.

4. The spring-loaded quick release mechanism according to claim 1, wherein the mounting bracket is attached to the underside of the first component.

5. The spring-loaded quick release mechanism according to claim 1, wherein the mounting bracket can be manufactured by a 3D process of an appropriate metal or plastic.

6. The spring-loaded quick release mechanism according to claim 1, wherein the quick-release latch is held onto the bipod or tripod by mounting screws.

7. The spring-loaded quick release mechanism according to claim 1, wherein the push button release, when depressed, disengages the ball pin from the quick-release latch, detaching the bipod or tripod from the mounting bracket.

* * * * *